United States Patent [19]

Johansson et al.

[11] Patent Number: 4,907,562

[45] Date of Patent: Mar. 13, 1990

[54] METHOD FOR ACHIEVING AN ELEVATED CHARGE OF AN IGNITION CAPACITOR IN A CAPACITIVE TYPE IGNITION SYSTEM

[75] Inventors: Hans Johansson; Jan Nytomt, both of Amal, Sweden

[73] Assignee: Saab-Scania Aktiebolag, Sweden

[21] Appl. No.: 274,317

[22] Filed: Nov. 18, 1988

[30] Foreign Application Priority Data

Nov. 24, 1987 [SE] Sweden ..... 8704641

[51] Int. Cl.[4] ..... F02P 3/08

[52] U.S. Cl. ..... 123/605; 123/179 BG; 123/596

[58] Field of Search ..... 123/179 BG, 596, 597, 123/598, 605

[56] References Cited

U.S. PATENT DOCUMENTS 4,541,390 9/1985 Steinbrenner et al. ..... 123/179 LX
4,683,859 8/1987 Tamura et al. ..... 123/491
4,785,789 11/1988 Johansson et al. ..... 123/596

*Primary Examiner*—Tony M. Argenbright
*Attorney, Agent, or Firm*—Ostrolenk, Faber, Gerb & Soffen

[57] ABSTRACT

The invention relates to a method for achieving elevated charging of an ignition capacitor in a capacitive type ignition system for internal combustion engines. When starting a cold engine or when starting the engine under other conditions in which the battery capacity is low, activation of the engine starting motor will result in a drop in voltage in the electric system serving both the starting motor and the ignition system. The voltage drop in the electrical system will vary sinusoidally synchronously with the crankshaft rotation, owing to the fact that the starting motor will momentarily subject the electrical system to higher loads when the pistons are located adjacent their top-dead-center position L in the compression stroke. The method solves this problem, by delaying the re-charging of the capacitor until a position is reached in which the voltage drop in the electrical system has its lowest value.

13 Claims, 3 Drawing Sheets

METHOD FOR ACHIEVING AN ELEVATED CHARGE OF AN IGNITION CAPACITOR IN A CAPACITIVE TYPE IGNITION SYSTEM

Capacitive type ignition systems for internal combustion engines will normally, and preferably, include a charging circuit in which the voltage is initially stepped up. A conventional charging circuit comprises a current-conducting coil, normally referred to as a choke, in which a given amount of energy is built-up, this energy being transferred from the choke to a parallel-connected capacitance, when the current is interrupted. By suitable dimensioning of the choke and the capacitance, it is possible, with a conventional 12 volt system, to build-up a voltage level of some 400 volts across the capacitor. The ignition system also includes a discharging circuit which is constructed to produce an ignition spark across the gap of a spark plug, this spark being generated in the engine cylinder or cylinders as the piston approaches the final stage of its compression stroke. The discharging circuit is also constructed to step-up the voltage still further. The discharging circuit may suitably be of the same kind as that described and illustrated in Swedish patent specification No. 437 286, corresponding to U.S. Pat. No. 4,637,368. This known discharging circuit comprises an ignition coil which is connected directly to its associated spark plug, the secondary winding of said coil being connected electrically to the spark plug and the primary winding thereof being connected in parallel across the charging circuit. An electrically controlled switch in the line which connects the primary winding to the charging circuit enables the charge energy accumulated in the charging circuit to be discharged via the primary winding, such as to generate an ignition spark in the plug gap, via the secondary winding. By suitably dimensioning the ignition coil, it is possible to step-up the voltage from 400 V to 40 000 V, this latter voltage being applied directly on the spark plugs.

The capacitive type ignition systems are distinguished by extremely rapid charging sequences. In the case of a conventional 12 volt electrical system, this charging time is in the order of from two to 10 ms. With prior art capacitive type ignition systems, charging is commenced immediately after a preceding discharge of the ignition capacitor. When the charging process is carried out very rapidly, there is time to charge the ignition capacitor before the next ignition occurrence, even at high engine speeds. When the engine is running at a low speed, however, for instance when starting the engine, such rapid charging means that the ignition capacitor will be held charged for a relatively long period of time before the next ignition occurrence.

In the case of a four-stroke internal combustion engine, a spark is generated at the spark plugs, when the respective piston is located at about two degrees of crankshaft rotation from its respective top-dead-centre position in the compression stroke. A normal ignition advance is about 10 degrees of crankshaft rotation (hereinafter referred to only as degrees). Since recharging of the ignition capacitor commences immediately upon termination of a preceding discharge, the ignition capacitor, at engine starting speeds, will be recharged before the respective piston has passed its top dead centre position, or at least before the piston is at 10 degrees after its top dead centre position.

This timing is unfavourable from a capacitor charging aspect in those cases when the engine starting motor is activated to effect an engine start. In this respect, the electrical system will be placed under additional strain, because the final compression phase of the compression stroke requires the starting motor to momentarily generate a higher torque. Consequently, charging of the ignition capacitor takes place at a time when the load on the electrical system is at its greatest and when the capacity of said system is at its lowest.

Normally, when starting an engine with the battery fully charged battery and at ambient temperatures above 0° C., there is no appreciable reduction in the amount of charge energy accumulated in the ignition capacitor.

On the other hand, in the case of cold engine starts at temperatures below −20° C., or engine starts when the battery is not fully charged, the power use of the starting motor can cause the normal voltage of the electrical system to fall from a standard 12 volts down to 8 volts. To this can be added a further momentary drop of two volts, down to 6 volts, in the electrical system during the final phase of the compression stroke. In the case of cold engine starts such as these, the level of voltage in the electrical system will swing in a sinusoidal fashion between a lowest voltage level and a slightly higher level. With prior art ignition systems, the charging of the ignition capacitor will take place when the voltage has a low value.

OBJECT OF THE INVENTION

The object of the present invention is to control the charging of the ignition capacitor during an engine starting sequence, with the starting motor activated, such that charging is effected at the highest possible voltage level in the electrical system. This object is achieved with the inventive method, the characteristic features of which follow.

The method enhances the possibility of producing an ignition spark which is sufficiently powerful to achieve a successful engine start in extremely cold conditions or in other cases where the available battery capacity is relatively low.

In accordance with one preferred embodiment, the voltage level of the electrical system is detected so as to ascertain when the starting motor exerts the smallest load on the electrical system. Preferably, the instantaneous voltage derivative is detected, by detecting continuously the instantaneous voltage and comparing this voltage with a value representative of a preceding instantaneous voltage level detected in the system and stored in a memory or data store in the ignition system.

According to an alternative embodiment, the torque characteristic of the engine concerned can be used to determine a fixed rotational position of the engine crankshaft at which torque is lowest and thus at which the smallest load is placed on the electrical system by the starting motor. In the case of a conventional four-stroke internal combustion engine in which the pistons are divided into pairs and each piston pair is displaced through 180 degrees in relation to the other pair and the pistons of one piston pair are displaced 360 degrees in phase, the lowest torque resistance occurs at about 60 degrees after the top dead centre position. This is because that piston of a piston pair which has been located in the top dead centre position in its final phase of the compression stroke and which commences its compression stroke, begins to impart positive torque to the crankshaft. As the crankshaft rotates away from the piston top dead centre position, this positive torque will be counteracted by the commencement of the compression stroke in another cylinder, belonging to the other piston pair.

In every type of piston engine concerned here, the instantaneous lowest torque resistance will occur at the same rotational position taken by the crankshaft after a piston begins to descend upon completion of its compression stroke. In the case of a six cylinder engine having three pairs of pistons connected in parallel and displaced through 120 degrees, this lowest torque resistance occurs at about 40 degrees of rotation after a top dead centre position.

As a result of this positive effect obtained through the expansion stroke in one cylinder and the negative countereffect obtained during the compression stroke in another cylinder, the lowest torque resistance during an engine starting sequence prevails when the crankshaft has rotated through about one-third of its total rotation from one top dead centre position to the next.

When the engine concerned is supercharged, this may cause the minimum torque resistance to be displaced to some extent and therewith to prevail at other crankshaft positions. However, when starting an engine of the kind in question, the minimum resistance to torque will always prevail at roughly the same rotational position of the crankshaft, and this fact is utilized in the inventive method.

Other characteristic features of the invention will be evident from the following claims and from the following description of an exemplifying embodiment of the invention. The description is given with reference to the accompanying drawings, in which FIG. 1 is a block schematic of a capacitive type ignition system for a four cylinder internal combustion engine;

DESCRIPTION OF A PREFERRED EMBODIMENT.

Figure 1:
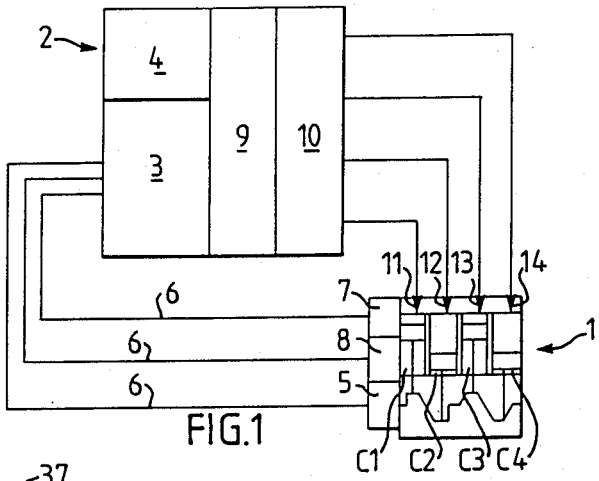

In the ignition system illustrated in FIG. 1, a signal is passed from a crankshaft sensor 5, mounted on an Otto cycle engine 1, through one of the lines 6 to an engine ignition system 2 which is controlled by a computer. The ignition system includes a control unit 3 which incorporates a microcomputer for calculating the ignition timing for respective engine cylinders on the basis of information arriving from the crankshaft sensor 5, an inlet pressure gauge 7, an engine temperature sensor 8, and any other additional sensor(s). The ignition system 2 is a capacitive system and further includes a charging circuit 4, discharge circuits 9 and ignition circuits 10 for the spark plugs 11–14 of respective cylinders C1, C2, C3, C4 of the Otto engine 1.

The cylinders form cylinder pairs C1, C3; C2, C4, in which respective cylinders run in parallel, in a known manner, but with a phase difference of 360 degrees. When the piston of one cylinder C1 of the cylinder pair C1, C3, is in the compression stroke of the four stroke cycle, the piston of the other cylinder C3 of said cylinder pair will be in its exhaust stroke. The pistons of this one cylinder pair C1, C3, however, are displaced in phase through 180 degrees in relation to the pistons of the other cylinder pair C2, C4, which means that when the pistons of said one cylinder pair C1, C3 are in their respective top dead centre positions, the pistons of the other cylinder pair C2, C4 are in their respective bottom dead centre positions.

Figure 2:
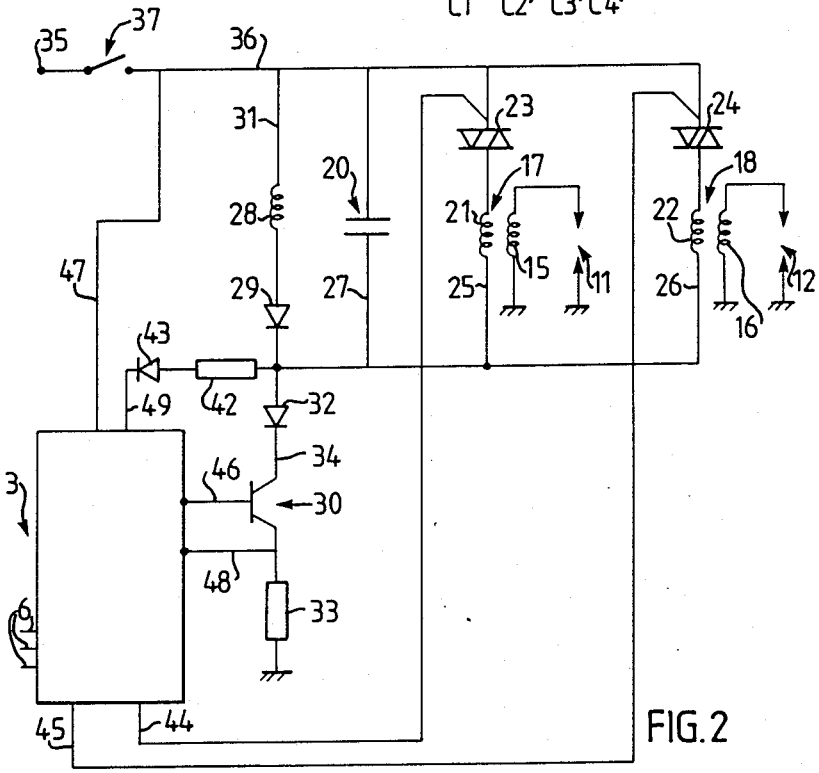
FIG. 2 is a principle circuit diagram of a capacitive type ignition system.

FIG. 2 illustrates those parts of the ignition system which are essential to the description of the present invention. Of the spark plugs 11–14 illustrated in FIG. 1, only the spark plugs 11 and 12 are shown here, and then only schematically, each of said plugs being connected to a respective secondary winding 15,16 of a corresponding number of ignition coils 17,18. Each of the primary windings 21, 22 of the ignition coils 17,18 is connected in series with a respective electric switch 23,24, which in the illustrated case have the form of triacs. Each primary winding 21,22 and triac 23,24 form a discharge circuit 25,26 which is connected in parallel with an ignition capacitor 20 incorporated in a line 27. Also connected in parallel with the ignition capacitor 20 is a coil 28, hereinafter called choke, which is connected in series with a diode 29 incorporated in a line 31. The line 27 incorporating the ignition capacitor 20, together with all lines 25,26,31 connected in parallel therewith, are connected on one side to a second electric switch 30, e.g. a transistor connected in series with a second diode 32 and a resistor 33 incorporated in a line 34, and on the other side to a direct current source 35, preferably a 12 V battery, via a line 36 which incorporates an ignition key switch 37. The diodes 29,32 are oriented so that when the transistor 30 is open to conduct current, current can be supplied from the battery 35 to earth, through the lines 31,34.

The triacs, 23,24 and the transistor 30 are controlled by signals sent from the control unit 3 on respective lines 44,45 and 46. In addition to the signals fed into the control unit 3 on the lines 6, shown in FIG. 1, the control unit 3 is also supplied on a line 47 with a signal indicative of the voltage level of the battery 35. A line 48 connects the control unit 3 with the line 34 extending between the transistor 30 and the resistor 33, and applies to the control unit 3 a potential which corresponds to the charging current. The control unit 3 also obtains data concerning the potential of the ignition capacitor 20, via a line 49 which incorporates a resistor 42 and a diode 43.

In principle, the arrangement illustrated in FIG. 2 operates in the following manner.

When starting the engine, the switch 37 closes the line 36 and the battery 35 delivers direct current to earth, via the charging circuit 31,34 which includes the choke 28, the diodes 29,32, the transistor 30 and the resistor 33. The control unit 3 thus holds the triacs 23,24 closed, whereas the transistor 30 is held open for the passage of current therethrough. When the charging current and a corresponding potential on the line 48 has reached a predetermined level, the passage of current through the transistor 30 is interrupted by the control unit 3. Energy stored in the choke 28 is therewith transferred to the capacitor 20, thereby charging said capacitor. When the control unit 3, in response to incoming signals on the lines 6,47,49, subsequently sends output signals to, e.g., the triac 23 at the first ignition time point determined in the control unit 3, the triac 23 is opened and the ignition capacitor 20 will discharge through the primary winding 21. In this way there is generated in the secondary winding 15 a first ignition voltage which produces a first ignition spark on the spark plug 11. The potential of the ignition capacitor 20 is detected by the control unit 3 via the line 49 and when the detected value is found to lie below a predetermined value, the control unit 3 will send an output signal on the line 46 to the transistor 30, causing the transistor to open. If the control unit 3 has detected that an engine starting sequence prevails and that the voltage level of the electrical system is too low, the control signal will be maintained on the line 44 so as to hold the triac 23 open. Consequently, when the charging current and a corresponding voltage potential on the line 48 has again reached a predetermined level, the control unit 3 will interrupt the passage of current through the transistor 30. The energy stored in the choke 28, however, will not be transferred to the capacitor 20, as in the case of the first ignition time point, but will instead decay in the discharging circuit, through the primary winding 21, without any of the charge reaching the capacitor. Since the potential of the ignition capacitor is held continuously at a low level, the control unit 3 will again open the transistor 30, by sending an output signal on the line 46. The transistor 30 will thus be opened and closed automatically in a number of cycles, without the capacitor being charged, as long as the triac 23 is held open. When the control unit 3 receives from the crankshaft sensor 5 a signal which indicates that the crankshaft occupies a rotational position in which the engine has an instantaneous low torque resistance to driving of the starting motor, or when the control unit 3 detects through the line 47 that the electrical system has a voltage peak, the output signal sent by the control unit 3 to the triac 23 on the line 44 will fall away. As a result, the subsequent charging of the capacitor 20 takes place at maximum system voltage. The charge accumulated in the capacitor will then be discharged at a subsequent ignition position over another discharge circuit, e.g. the primary winding 22, when the piston of the cylinder is located in the final phase of its compression stroke. Consequently, the ignition spark in this cylinder will have a higher energy content than when the ignition capacitor is charged at a lower system voltage.

In a similar manner, the control unit 3 will then ensure that the capacitor 20 is charge at maximum system voltage in subsequent ignition positions.

Figure 3:
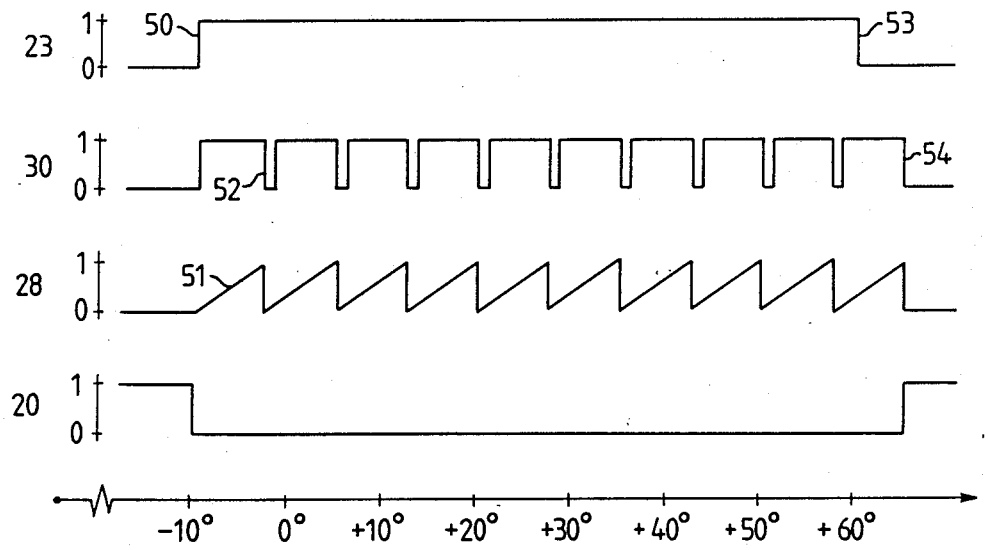
FIG. 3 is a constitutional diagram which illustrates, for crankshaft rotational positions adjacent the top dead centre, the current or voltage state of the ignition system components of a preferred embodiment.

FIG. 3 illustrates the levels of the control signals sent to the triac 23 and the transistor 30, and also shows the operational state of the capacitor 20 and the choke 28 over an angular crankshaft range around the top dead centre position, TDC. In the case of the triac 23 and the transistor 30, the zero-level represents a closed position and the one-level represents an open position. In the case of the choke 28 and the capacitor 20, the zero level indicates no choke current and no charge respectively, whereas the one-level represents a fully developed choke current and a fully charged capacitor respectively. The diagram illustrates the current or voltage states of components over a crankshaft range extending from a normal ignition position of 10 degrees before TDC, in the diagram −10 degrees, to slightly more than 60 degrees after TDC, and particularly 60 degrees after "TDC" plus or minus 5 degrees. Ignition across a spark plug at the ignition position is thus obtained by opening the triac 23 at −10 degrees in position 50. In this case, the capacitor 20 can be discharged across the discharging circuit so as to generate a spark in the spark plug gap. The triac 23 is then held open until the capacitor 20 is to be re-charged at a later stage. When the control unit 3 detects through the line 49 that the potential of the capacitor 20 has become low due to the discharge of energy therefrom, the control unit 3 will automatically open the transistor 30, by sending a control signal on the line 46. The choke 28 will therewith become conductive and the current through the choke 28 will be built-up along a ramp 51. When the control unit 3, subsequent to some further degrees of rotation of the crankshaft to position 52, detects on the line 48 a potential which indicates that the current through the choke 28 is fully developed, the control units will close the transistor 30 so as to interrupt the passage of current therethrough. Since the triac 23 is still open, the energy present in the choke 28 will decay over the discharging circuit and will not therefore accumulate in the capacitor 20. This opening and closing of the transistor 30, with subsequent development of the choke current, thus takes place in a plurality of cycles, in the diagram nine cycles, without the capacitor 20 being charged when the triac 23 is held open during this period. When the control unit 3 subsequently closes the triac 23 at the position 53 of maximum voltage, in the diagram 60 degrees after TDC plus or minus 5 degrees, subsequent closing of the transistor 30 in the position 54 will cause the energy built-up in the choke 28 to be accumulated in the capacitor 20. The charge obtained in the capacitor 20 can then be discharged in a following ignition position, to generate an ignition spark in a conventional manner.

Figure 4:
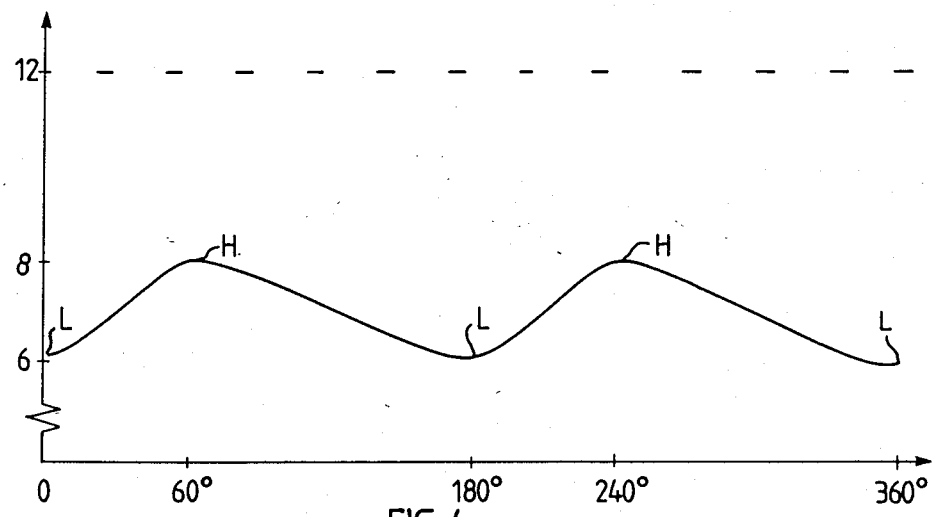
FIG. 4 illustrates voltage variations in the electrical system as a function of the rotational position of the crankshaft of a four stroke engine when activating the engine starting motor.

FIG. 4 illustrates the sinuosoidal voltage variation of the electrical system when effecting a cold engine start of a conventional four-cylinder internal combustion engine. When starting a cold engine, activation of the engine starting motor may cause a general drop in voltage from the standard system voltage of 12 volts down to, e.g. 8 volts. At those crankshaft positions in which the pistons are located at their respective top-dead-centre positions, i.e. in the crankshaft positions of 180 and 360 degrees, in which the highest instantaneous torque resistance prevails in the engine, the system voltage has fallen further, down to 6 volts in the illustrated example of FIG. 4. These voltage troughs recur cyclicly with 180-degrees phase displacement synchronously with the crankshaft. In the case of the aforesaid type of internal combustion engine, the voltage peaks will occur at 60 degrees after said voltage troughs.

Figure 5:
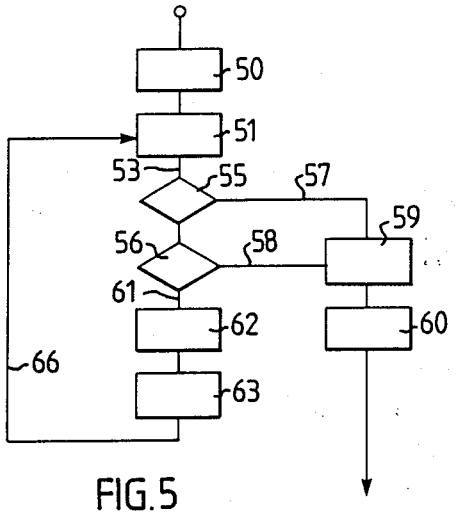
FIG. 5 is a flow diagram which illustrates the detection of an engine starting sequence when the engine is cold or when the battery voltage is low.

In accordance with the inventive method, the control unit 3 controls engine ignition in accordance with an engine starting program stored in the microcomputer of said unit, as illustrated in the flow diagram of FIG. 5.

The program commences with an operation stage 50, in which the pulses of the output signal from the crankshaft sensor 5 are related to the cylinder pairs C1,C3 and C2,C4 respectively in a manner known per se. The pulses related to respective cylinder pairs are repeated at intervals of 180-degrees and exhibit between a first negative flank and a second positive flank a distance which corresponds, e.g., to 35 degrees. The next 180-degree pulse, which may, for instance, concern the cylinder pair C1,C3, is awaited in a subsequent operation stage 51. When the negative flank of the pulse is detected, the program follows a flow line 53 to an enquiry stage 55, in which it is established whether the speed of the engine is higher or lower than, for instance, 400 rpm. This constitutes a criterion of whether or not the engine can be considered to have left the engine starting sequence. If the engine speed is found to be beneath said limit, the program continues to a further enquiry stage 56, in which it is established whether or not the battery voltage is below or above, for instance, 11 volts. This voltage limit is used as a criterion for determining whether or not the capacity of the electric system is acceptable.

If the detected engine speed is found to be above or equal to 400 rpm, or the battery voltage is found to be above or equal to 11 volts, in accordance with enquiry stages 55,56, the program continues, via flow lines 57 and 58 respectively, to an operating stage 59, which is responsible for caming ignition in the cylinder or cylinders being ready for ignition. Ignition is effected as the result of the application of a short output signal from the control unit 3 on the triacs of respective cylinders, i.e. the triac 23 of the cylinder C1. In this way, re-charging of the ignition capacitor is started automatically, without awaiting any later position, since if the engine speed is higher than 400 rpm, or the battery has a sufficiently high capacity, there is no reason to delay charging of the capacitor until a maximum voltage state prevails. In those cases when the ignition system lacks a camshaft sensor and when the ignition sequence is not a determined sequence when starting the engine and ignition sparks are generated in both the cylinders that are located in their TDC-positions, the operation stage 59 is followed by an operation stage 60, in which it is ascertained whether ignition has occurred in cylinder C1 or cylinder C3. This can be effected with an ionizing current device of the kind illustrated and described in our Swedish Pat. No. 442 345. On the basis of the data concerning ignition in either cylinder, the control unit determines the engine ignition sequence, which constitutes the end product of the engine starting program. This forms the basis for the further control of engine ignition by the control unit 3.

However, should the engine speed be found to lie beneath 400 rpm and the battery voltage found to be lower than 11 volts, the engine starting program follows a flow line 61 to an operation stage 62, in which ignition is effected in the cylinder or cylinders in which the piston, or pistons, is/are located in an ignition position. Under these conditions, the ignition is effected by applying a constant, prevailing output signal on the triac of each respective cylinder.

The program then passes to an operation stage 63, in which the control unit awaits a voltage maximized state of the electric system. As beforementioned, this state can be detected either in the form of a signal from the crankshaft sensor, from a fixed crankshaft position, or by detection of a voltage peak by the control unit 3. When this operational state occurs, the control unit 3 discontinues the signal on the triacs of respective cylinders As a result, charging of the ignition capacitor will be delayed until a maximum voltage state is reached when the engine speed is beneath 400 rpm and the battery voltage is lower than 11 volts.

The program then continues from the operation stage 63, along a flow line 66, back to the operation stage 51, where the next 180-degree pulse from the crankshaft sensor is awaited. This pulse represents the other cylinder pair C2,C4, and when the negative flank of the pulse is detected, the engine starting program again follows the flow diagram in the manner aforedescribed.

Thus, the inventive method enables charging of the ignition capacitor to be modified in an engine starting sequence where the battery capacity is low. Because the ignition system delays charging of the capacitor until there is reached an operational state in which the lowest torque resistance prevails and in which the starting motor exerts the smallest instantaneous load on the electrical system, charging of the capacitor will take place when the capacity of the electrical system is at its greatest.

The aforedescribed triacs can be controlled in the microcomputer-control ignition circuit in ways other than that aforedescribed.

In accordance with one variant of the inventive method, the control unit is constructed to control the triacs 23,24 and the transistor 30 in a manner such that the triacs 23,24 will close and the transistor 30 will open immediately after the control unit has detected that the potential of the ignition capacitor 20 has fallen due to a preceding discharging process. Opening and closing preferably takes place when the potential of the capacitor 20 is below 100 volts if a fully charged ignition capacitor corresponds to a potential of 400 volts. The control unit 3 will then block the transistor 30 in an open position until the aforesaid time is reached for charging of the capacitor, thereby delaying charging of the capacitor until a state of maximum system voltage prevails.

In accordance with another variant of the inventive method, charging of the ignition capacitor is delayed by making the control unit 3 hold the transistor 30 closed until said charging time point occurs, whereupon the control unit 3 will open the transistor and charging of the capacitor will automatically follow when the choke current is fully developed.

The aforedescribed exemplifying embodiments do not limit the scope of the invention, since other modifications are conceivable within the scope of the following claims. For example, the reference to an ignition capacitor and like device is intended to include solutions with several ignition capacitors connected in parallel and functioning as one single capacitance.

We claim:

1. A method for achieving elevated charging of an ignition capacitor of a capacitive ignition system for internal combustion engines when starting the engine with the starting motor activated, in which the starting motor and ignition system are served by a common electrical system, characterized in that charging of the ignition capacitor is not commenced until a state in the engine working cycle is reached in which the starting motor has its substantially lowest requirement of power from the electrical system of the engine, this state falling between two compression strokes in the engine working cycle where the instantaneous torque resistance of the engine is substantially at its lowest value.

2. A method according to claim 1, characterized in that charging the capacitor commences when the instantaneous voltage derivative in the electrical system passes to a negative value.

3. A method according to claim 1, characterized in that charging of the capacitor commences at a fixed crankshaft position which indicates that the pistons connected to the crankshaft are located in a position intermediate of their respective top-dead-centre and bottom-dead-centre positions.

4. A method according to claim 3 for application in a four-cylinder engine having parallel-coupled piston pairs which are mutually displaced through 180 crankshaft degrees, characterized in that charging of the capacitor is commenced at a crankshaft position of 60 crankshaft degrees, plus or minus 5 crankshaft degrees after the top dead centre position of either piston pair.

5. A method according to claim 2, in which the ignition system includes a charging circuit comprising a choke (28) and a parallel-coupled ignition capacitor (20), and in which the charging circuit is connected in series with a voltage source (35) on one side and with a switch (30) in the earth connection, on the other side, said switch being controlled by the control unit, characterized in that charging of the ignition capacitor (20) is initiated by a control current which activates the switch (30) in a manner such that the earth connection is not broken until the time at which charging of the capacitor commences subsequent to the control current being applied to the switch (30) after a preceding discharge of the capacitor (20).

6. A method according to claim 2, in which the ignition system includes a charging circuit comprising a choke (28) and a parallel-connected ignition capacitor (20), and in which the charging circuit is coupled in series with a voltage source (35) on one side and with a switch (30) in the earth connection, on the other side, said switch being controlled by the ignition system control unit (3), characterized in that charging of the ignition capacitor (2) is commenced by sending from the control unit (3) a control current to the switch (30) only when charging is to commence subsequent to a preceding discharge; and in that the control current sent to the switch (30) is broken when the current through the choke (28) is fully developed.

7. A method according to claim 2, in which the ignition system includes a charging circuit comprising a choke (28) and an ignition capacitor (20) connected in parallel, and in which the charging circuit being connected in series with a voltage source (35) on one side and with a switch in the earth connect tion on the other side, said switch being controlled by a control unit (3) in the ignition system, and a plurality of discharge circuits connected in parallel across the charging circuit, in which each discharge circuit comprises a switch (23,24) connected in series with a primary winding (21,22) of an ignition coil connected to a spark plug incorporated in the engine, characterized in that the discharge circuit is held in a current conducting state subsequent to a preceding discharge by supplying to the switch (23,24) a continuous trigger current until said capacitor charging time occurs, wherewith the control current to the switch (23,24) falls away and the charging circuit commences to charge the ignition capacitor (20).

8. A method according to claim 3, in which the ignition system includes a charging circuit comprising a choke (28) and a parallel-coupled ignition capacitor (20), and in which the charging circuit is connected in series with a voltage source (35) on one side and with a switch (30) in the earth connection, on the other side, said switch being controlled by the control unit, characterized in that charging of the ignition capacitor (20) is initiated by a control current which activates the switch (30) in a manner such that the earth connection is not broken until the time at which charging of the capacitor commences subsequent to the control current being applied to the switch (30) after a preceding discharge of the capacitor (20).

9. A method according to claim 4, in which the ignition system includes a charging circuit comprising a choke (28) and a parallel-coupled ignition capacitor (20), and in which the charging circuit is connected in series with a voltage source (35) on one side and with a switch (30) in the earth connection, on the other side, said switch being controlled by the control unit, characterized in that charging of the ignition capacitor (20) is initiated by a control current which activates the switch (30) in a manner such that the earth connection is not broken until the time at which charging of the capacitor commences subsequent to the control current being applied to the switch (30) after a preceding discharge of the capacitor (20).

10. A method according to claim 3, in which the ignition system includes a charging circuit comprising a choke (28) and a parallel-connected ignition capacitor (20), and in which the charging circuit is coupled in series with a voltage source (35) on one side and with a switch (30) in the earth connection, on the other side, said switch being controlled by the ignition system control unit (3), characterized in that charging of the ignition capacitor (2) is commenced by sending from the control unit (3) a control current to the switch (30) only when charging is to commence subsequent to a preceding discharge; and in that the control current sent to the switch (30) is broken when the current through the choke (28) is fully developed.

11. A method according to claim 4, in which the ignition system includes a charging circuit comprising a choke (28) and a parallel-connected ignition capacitor (20), and in which the charging circuit is coupled in series with a voltage source (35) on one side and with a switch (30) in the earth connection, on the other side, said switch being controlled by the ignition system control unit (3), characterized in that charging of the ignition capacitor (2) is commenced by sending from the control unit (3) a control current to the switch (30) only when charging is to commence subsequent to a preceding discharge; and in that the control current sent to the switch (30) is broken when the current through the choke (28) is fully developed.

12. A method according to claim 3, in which the ignition system includes a charging circuit comprising a choke (28) and an ignition capacitor (20) connected in parallel, and in which the charging circuit being connected in series with a voltage source (35) on one side and with a switch in the earth connection (30) on the other side, said switch being controlled by a control unit (3) in the ignition system, and a plurality of discharge circuits connected in parallel across the charging circuit, in which each discharge circuit comprises a switch (23, 24) connected in series with a primary winding (21, 22) of an ignition coil connected to a spark plug incorporated in the engine, characterized in that discharge circuit is held in a current conduction state subsequent to a preceding discharge by supplying to the switch (23, 24) a continuous trigger current until said capacitor charging time occurs, wherewith the control current to the switch (23, 24) falls away and the charging circuit commences to charge the ignition capacitor (20).

13. A method according to claim 4, in which the ignition system includes a charging circuit comprising a choke (28) and an ignition capacitor (20) connected in parallel, and in which the charging circuit being connected in series with a voltage source (35) on one side and with a switch in the earth connection (30) on the other side, said switch being controlled by a control unit (3) in the ignition system, and a plurality of discharge circuits connected in parallel across the charging circuit, in which each discharge circuit comprises a switch (23, 24) connected in series with a primary winding (21, 22) of an ignition coil connected to a spark plug incorporated in the engine, characterized in that discharge circuit is held in a current conducting state subsequent to a preceding discharge by supplying to the switch (23, 24) a continuous trigger current until said capacitor charging time occurs, wherewith the control current to the switch (23, 24) falls away and the charging circuit commences to charge the ignition capacitor (20).

* * * * *